United States Patent [19]

Wüthrich et al.

[11] 4,296,289

[45] Oct. 20, 1981

[54] ELECTRIC GAS-BLAST SWITCH

[75] Inventors: Hans-Rudolf Wüthrich, Oberentfelden; Peter Krebs, Hirschtal; Hubert Spiegel, Oberentfelden; Franz Eicher, Aarau, all of Switzerland

[73] Assignee: Sprecher & Schuh AG, Aarau, Switzerland

[21] Appl. No.: 24,465

[22] Filed: Mar. 26, 1979 (Under 37 CFR 1.47)

[30] Foreign Application Priority Data

Apr. 19, 1978 [CH] Switzerland ..... 4176/78

[51] Int. Cl.[3] ..... H01H 33/70

[52] U.S. Cl. ..... 200/148 R; 200/146 R; 200/149 A

[58] Field of Search ..... 200/146 R, 148 A, 150 L, 200/149 A

[56] References Cited

U.S. PATENT DOCUMENTS

| | | | |
|---|---|---|---|
| 2,365,132 | 12/1944 | Amer et al. | 200/146 R |
| 2,933,575 | 4/1960 | Baker | 200/148 A |
| 3,158,723 | 11/1964 | Buechner | 200/148 A |
| 3,686,453 | 8/1972 | Floessel | 200/146 R |
| 4,032,736 | 6/1977 | Ruffieux et al. | 200/147 R |

FOREIGN PATENT DOCUMENTS

| | | | |
|---|---|---|---|
| 591869 | 4/1959 | Italy | 200/148 R |
| 575108 | 2/1946 | United Kingdom | 200/148 R |

*Primary Examiner*—Robert S. Macon

*Attorney, Agent, or Firm*—Werner W. Kleeman

[57] ABSTRACT

A movable, substantially tubular-shaped contact element coacts with a fixed set of contacts which, in turn, possesses a rim of rated current contacts, a burn-off rim electrically connected with the rated current contacts, and an intermediate electrode arranged electrically insulated from the rated current contacts. In order to prevent, during the cut-off operation, commutation of the base point of the arc from the burn-off rim back to the contact surfaces of the rated current contacts, the burn-off rim is arranged within the rim of rated current contacts and inwardly offset with respect to their contact surfaces. In the cut-on position the burn-off rim surrounds a burn-off tip secured at the end of the movable contact element. The burn-off tip engages with the intermediate electrode. Between the contact surfaces of the rated current contacts and the burn-off rim there can be arranged an insert formed of a material which, in the presence of an arc, gives off a gas. A similar insert also can be arranged at the other side of the burn-off rim.

12 Claims, 1 Drawing Figure

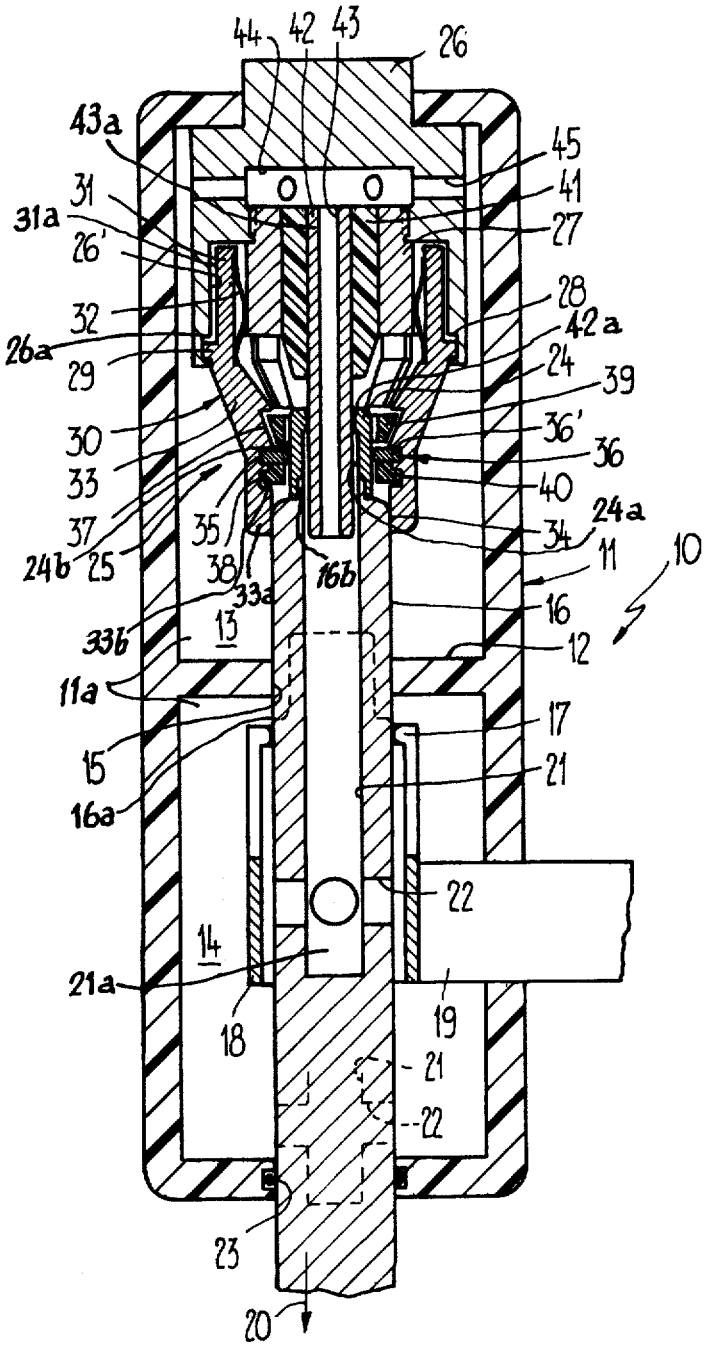
44
42
43
26
43a
45
41
31
31a
27
26'
28
32
42a
26a
24
29
39
30
36'
36
33
40
37
24a
35
34
24b
25
38
16b
11
10
33a
16
33b
13
12
11a
17
15
21
16a
22
14
21a
18
19
21
22
23
20

ELECTRIC GAS-BLAST SWITCH

BACKGROUND OF THE INVENTION

The present invention relates to a new and improved construction of electrical gas-blast switch.

The gas-blast switch of the invention is the type comprising a movable, substantially tubular-shaped contact element which can be brought into and out of engagement with a fixed set of contacts which, in turn, possesses a rim of rated current contacts. In the cut-on position of the switch the rated current contacts engage about the movable contact element. Further, there is provided a burn-off rim electrically connected with the rated current contacts as well as an intermediate electrode surrounded by the rim of rated current contacts, however electrically insulated therefrom.

With a state-of-the-art switch of this type, as disclosed in Swiss Pat. No. 574,673, the burn-off rim, constructed as a ring, is arranged ahead of the rated current contacts. This burn-off rim is electrically connected with the rated current contacts by means of a coil coaxially arranged with respect to the lengthwise axis of the switch or by means of an electrically conductive contact flange which is in direct contact with the rated current contacts. The intermediate electrode, arranged to be electrically insulated from the rated current contacts, extends past the rated current contacts and the burn-off ring. During the course of the cut-off movement there occur, with the prior art switch, the following operations: Initially, the movable contact element is brought out of engagement with the rated current contacts, but however remains practically in engagement with the burn-off ring, so that the cut-off current flows through the coil arranged forwardly of the burn-off ring. This coil, in turn, produces a magnetic field which is essentially coaxial with respect to the switch axis. If the movable contact departs from the burn-off ring, then initially there is drawn an arc between the movable contact element and the burn-off ring. The contact side-base point of the arc is driven into the interior of the movable contact element owing to the pressure surge which is produced by the arc itself. With increased spacing between the movable contact element and the burn-off ring the arc commutates to the intermediate electrode, thereby forming a two-part arc, namely, a first arc part or portion between the burn-off ring and the intermediate electrode and a second arc part or portion between such intermediate electrode and the movable contact element. Now since every arc strives to move along the path of least resistance, with the heretofore known gas-blast switch, owing to the coil (impedance) connected forwardly of the burn-off ring, there is not insured in any way that the one base point of the aforementioned first arc part will remain at the burn-off ring and will not commutate back to the rated current contacts which—since they are no longer forced apart by the movable contact element—have a smaller radial spacing with respect to the intermediate electrode than the inner diameter of the burn-off ring. What results is an undesired burn-off of the contact surfaces of the rated current contacts.

SUMMARY OF THE INVENTION

Hence, it is a primary object of the present invention to provide a new and improved construction of gas-blast switch of the previously mentioned type wherein the aforementioned drawbacks are extensively eliminated.

Yet a further significant object of the present invention aims at the provision of a new and improved construction of gas-blast switch of the previously mentioned type which is structured in such a manner that the one base point of the first arc portion always remains at the burn-off rim, in other words, at a part subject to wear.

A further significant object of the present invention proposes a novel construction of gas-blast switch which extensively eliminates the aforementioned shortcoming and drawbacks of the prior art constructions discussed above, but nonetheless is of relatively simple construction and design, extremely reliable in operation, not readily subject to malfunction or breakdown and has enhanced service life of the switch.

Now in order to implement these and still further objects of the invention, which will become more readily apparent as the description proceeds, the gas-blast switch proposed by the present development is manifested by the features that the burn-off rim is arranged within the rim of rated current contacts and is rearwardly offset or inset with respect to the contact surfaces of the rated current contacts which coact with the movable contact element. In the cut-on position of the switch the burn-off rim encloses a substantially tubular-shaped burn-off tip which is attached at the end of the movable contact element and such burn-off tip engages with the intermediate electrode.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE shows in schematic axial sectional view a gas-blast switch according to the invention, there having been conveniently omitted from the drawing, to preserve clarity in illustration, all of the elements or components otherwise conventionally provided at such gas-blast switch which are not necessary for understanding the subject matter of the present invention.

DETAILED DESCRIPTION OF THE PREFERRED EMBODIMENTS

Describing now the drawing, the exemplary embodiment of gas-blast switch 10 illustrated therein will be seen to comprise a housing 11 formed of any suitable electrically insulating material. The inner compartment or space 11*a* of this housing 11 is subdivided, by means of an intermediate wall or partition 12, into an extinguishing chamber or compartment 13 and an expansion chamber or compartment 14. A bore 15 is formed at the intermediate wall 12 and through which there is displaceably guided an essentially tubular-shaped, movable contact element 16. In the expansion chamber or compartment 14 the outer diameter or surface 16*a* of the movable contact element 16 always is in engagement with a set of resilient slide contacts 17. The slide contacts 17 are arranged at a holder or support ring 18 which, in turn, is attached to a connection line or conductor 19 or equivalent structure which radially protrudes out of the housing 11.

The not particularly illustrated lower end of the contact element 16, which is movably guided out of the housing 11 through a sealed passageway or opening 23, is operatively coupled with any suitable drive, as is well known in this art, and by means of which it is possible to displace the contact element 16, illustrated in the cut-on position of the gas-blast switch, in the direction of the arrow 20 into the cut-off position indicated with broken lines. The movable contact element 16 possesses an axially extending blindhole bore 21, at the lower end region 21*a* of which there extend the radial passageways or openings 22 which flow communicate with the expansion compartment 14. At the upper end 16*b* of the contact element 16 there is attached a likewise essentially tubular-shaped burn-off tip 24, for instance formed of a copper-tungsten alloy (Cu—W alloy). The inner diameter or surface 24*a* of this burn-off tip memeber 24 is in alignment with the blindhole bore 21, whereas its outer surface 24*b* has a diameter which is less than that of the contact element 16.

The movable contact element 16 and the therewith attached burn-off tip or tip member 24 cooperate with a set 25 of fixed contact elements, details of which will be considered more fully hereinafter. This fixed contact set 25 is mounted at a metallic support or mounting block 26, simultaneously serving as the housing closure and as connection flange, and at a support or mounting tube 27 which is threaded at or otherwise appropriately fixed at the support or mounting block 26. The essentially pot-shaped and downwardly open support or mounting block 26 possesses an inwardly open groove 28 at the region of its lower end or edge 26*a*. Engaging with this inwardly open groove or channel 28 are the protuberances or cams 29 or equivalent structure, formed at the outer surface of contact fingers 30 constructed as double-arm levers. The contact fingers 30 constitute rated current contacts. The arm 31 of each contact finger 30, which arm merges with the top of the related protuberance or cam 29, is exposed to the action of a leaf spring 32 or equivalent structure which is supported at the outer side of the support or holder tube 27. These leaf springs 32 or the like strive to outwardly force the related arm 31 of the contact fingers 30. The other arm 33 of each contact finger 30, which merges with the lower face or bottom of each protuberance or cam 29, carries at the region of its lower end 33*a*, at the inside or inner wall thereof, a contact surface 34 which, in the illustrated cut-on position of the gas-blast switch, bears under the action of the related leaf or blade spring 32 snugly against the outer circumference or surface 16*a* of the movable contact element 16.

A notch or groove 35 is provided at the inner surface 33*b* of each arm 33, each such notch or groove 35 being rearwardly arranged or inset with respect to the contact surface 34. A respective burn-off element 36' is inserted into the notches or grooves 35 of the contact fingers 30 arranged as a rim having intermediate spaces. These burn-off elements or members 36' thus form a burn-off rim 36 whose inner diameter is somewhat larger than the outer diameter of the burn-off tip 24. To both sides of the grooves or notches 35 there is formed at the inner surface 33*b* of each of the arms 33 a respective further notch or groove 37 and 38 which are inwardly open. Inserted into these notches or grooves 37 and 38 are the respective ring-shaped or annular inserts 39 and 40 formed of a material which, in the presence of an arc, gives off a gas, for instance formed of polytetrafluoroethylene which has been leaned with a suitable filler. The inner diameter of the inserts or insert memebers 39 and 40 is somewhat larger than that of the burn-off rim 36.

Attached within the support tube 27 is an insulating sleeve 41 within which there is retained a substantially tubular-shaped intermediate electrode 42, preferably formed of a non-metallic, electrically conducting material, such as typically for instance graphite. The intermediate electrode 42 extends up to the free ends 33*a* of the contact fingers 30 and, in the cut-on position, engages by means of its outer surface 42*a* with the inner surface 24*a* of the burn-off tip 24. A continuous bore 43 provided throughout the intermediate electrode 42 opens at its end 43*a* supported in the sleeve 41 at a chamber or compartment 44 formed in the support of holder block 26. Radial bores 45 extend outwardly of the chamber or compartment 44 and open into the part of the extinguishing or quenching compartment 13 surrounding the support block 26. Consequently, there is provided a free flow communication or connection which enables the pressure gases formed during the cut-off operation, under the effect of the arc, to expand as rapidly as possible in the extinguishing chamber or compartment 13 and from that location—as will be still described more fully hereinafter—to move through the bore 21 and the passageways 22 and to expand in the expansion chamber or compartment 14.

During the cut-off stroke of the switch the following operations occur: Initially, the upper end region of the movable contact element 16 comes out of engagement with the contact surfaces 34. The arms 33 of the contact fingers 30 resiliently move inwardly to such an extent until the outer surfaces 31*a* of the arms 31 bear against the inner wall 26' of the support block or support member 26, and thus, have a good electrical contact with the support block 26. The cut-off current now flows only via the burn-off element 36' of the rim 36 and the burn-off tip 24. If thereafter this burn-off tip 24 moves out of contact with the burn-off rim 36 then initially an arc is drawn between both of these elements. With increasing axial spacing of the burn-off tip 24 with respect to the burn-off rim 36 the arc commutates to the intermediate electrode 42, so that the cut-off current now flows—it being mentioned that the burn-off tip 24 has not yet come out of contact with the intermediate electrode 42—by means of the burn-off rim 36, the arc, the intermediate electrode 42 and the burn-off tip 24. At the same time there is formed an increased gas pressure in the extinguishing chamber or compartment 13 due to the arc, but such increased gas pressure cannot yet escape. Now if the burn-off tip 24 comes out of contact with the intermediate electrode 42 then between both of these elements there is drawn a further arc and at the same time there is formed a flow connection to the expansion chamber 14, namely, as already alluded to above, by means of the inside of the hollow burn-off 24, the bore 21 and the passageways 22 which, in the meantime, have moved out of the region of the holder or support ring 18. Consequently, the pressure which has built-up in the extinguishing chamber or compartment 13 can discharge in the direction of the expansion chamber or compartment 14, and the arc burning between the intermediate electrode 42 and the burn-off tip 24 can be forcefully blown or flushed and driven into the burn-off tip 24. The arc which burns between the burn-off rim 36 and the intermediate electrode 42 does not have any tendency to commutate to the contact fingers 30, firstly because the radial spacing to the contact fingers 30 is greater than to the inner diameter or surface of the burn-off rim 36, and secondly, because the gas developed by the insert members or inserts 39 and 40 forms an obstruction for commutation.

The contact surfaces over which flows the rated current, namely the contact surfaces 34 and the outer diameter or surface 16a of the movable contact element 16 are thus free of any burn-off which, in turn, only arises at the burn-off elements 36', at the intermediate electroce 42 and at the burn-off tip 24, in other words at wearable parts which are easy to exchange.

While there are shown and described present preferred embodiments of the invention, it is to be distinctly understood that the invention is not limited thereto, but may be otherwise variously embodied and practiced within the scope of the following claims. Accordingly,

What we claim is:

1. An electrical gas-blast switch comprising:

a fixed set of contacts;

a movable, substantially tubular-shaped contact element which can be brought into and out of engagement with said fixed set of contacts;

said fixed set of contacts comprising:

a rim of rated current contacts which in a cut-on position of the switch engages about said movable contact element;

a burn-off rim electrically connected with the rated current contacts;

an intermediate electrode surrounded by said rim of rated current contacts but electrically insulated from the latter;

said rim of rated current contacts having contact surfaces cooperating with said movable contact element;

said burn-off rim being arranged within said rim of rated current contacts and rearwardly offset with respect to the contact surfaces of said rated current contacts which cooperate with said movable contact element;

a substantially tubular-shaped burn-off tip mounted at an end region of the movable contact element;

said burn-off rim, in the cut-on position of the switch, surrounds said burn-off tip and said burn-off tip engages with said intermediate electrode.

2. The gas-blast switch as defined in claim 1, wherein:

the outer diameter of the burn-off tip is less than the outer diameter of the movable contact element.

3. The gas-blast switch as defined in claim 2, further including:

an insert formed of a material which gives off a gas in the presence of an arc;

said insert being arranged between said burn-off rim and the contact surfaces of the rated current contacts.

4. The gas-blast switch as defined in claim 1, further including:

an insert formed of a material which gives off a gas in the presence of an arc;

said insert being arranged between said burn-off rim and the contact surfaces of the rate current contacts.

5. The gas-blast switch as defined in claim 1, wherein:

said rated current contacts comprising contact fingers arranged in a rim;

resilient means for radially outwardly displacing said contact fingers; and said burn-off rim comprises burn-off elements mounted at said contact fingers.

6. The gas-blast switch as defined in claim 5, further including:

an insert formed of a material which gives off a gas in the presence of an arc;

said insert being arranged between said burn-off rim and the contact surfaces of the rated current contacts; and said insert being mounted by said contact fingers.

7. The gas-blast switch as defined in claim 5, wherein:

said gas-blast switch has a lengthwise extending switch axis;

a groove provided at the side of each contact finger confronting the switch axis;

the burn-off elements being inserted into said grooves.

8. The gas-blast switch as defined in claim 4, further including:

an additional insert formed of a material which gives off a gas in the presence of an arc;

said additional insert being arranged at the side of the burn-off rim which faces away from the contact surfaces of the rated current contacts.

9. The gas-blast switch as defined in claim 1, wherein:

said burn-off tip is formed of an electrically conductive alloy containing tungsten.

10. The gas-blast switch as defined in claim 9, wherein:

said alloy is a copper-tungsten alloy.

11. The gas-blast switch as defined in claim 1, wherein:

said intermediate electrode is formed of a non-metallic, electrically conductive material.

12. The gas-blast switch as defined in claim 11, wherein:

said non-metallic, electrically conductive material is graphite.

* * * * *